US007506487B2

(12) United States Patent
Eads et al.

(10) Patent No.: US 7,506,487 B2
(45) Date of Patent: Mar. 24, 2009

(54) METHOD FOR APPLYING A RECLOSABLE SEAL TO A CONTAINER

(75) Inventors: Claude Alan Eads, Maineville, OH (US); Rainer M. Garger, Vienna (AT); Thomas P. O'Connor, Shebyville, IN (US)

(73) Assignee: Zip Pack IP AG, Goldach (CH)

( * ) Notice: Subject to any disclaimer, the term of this patent is extended or adjusted under 35 U.S.C. 154(b) by 497 days.

(21) Appl. No.: 11/231,472

(22) Filed: Sep. 21, 2005

(65) Prior Publication Data

US 2007/0066470 A1 Mar. 22, 2007

(51) Int. Cl.
*B65B 61/18* (2006.01)
*B31B 1/90* (2006.01)

(52) U.S. Cl. ..... 53/412; 53/133.4; 53/139.2; 493/212; 493/213; 493/214; 493/927; 383/5; 383/63; 383/203

(58) Field of Classification Search ..... 53/412, 53/133.4, 139.2; 493/212, 213, 214, 927; 383/5, 63, 61.3, 64, 203, 204, 207; 156/66; 24/64; 29/408, 409, 410, 768
See application file for complete search history.

(56) References Cited

U.S. PATENT DOCUMENTS

| | | | | |
|---|---|---|---|---|
| 3,693,867 | A * | 9/1972 | Schwarzkopf | 383/27 |
| 3,807,626 | A | 4/1974 | Goodrich | |
| 4,353,770 | A | 10/1982 | Kuckhermann | |
| 4,620,320 | A | 10/1986 | Sullivan | |
| 4,971,454 | A | 11/1990 | Branson et al. | |
| 5,035,517 | A | 7/1991 | Edelman | |
| 5,048,692 | A | 9/1991 | Handler et al. | |
| 5,442,837 | A | 8/1995 | Morgan | |
| 5,564,259 | A | 10/1996 | Stolmeier | |
| 5,662,420 | A | 9/1997 | Sinda et al. | |
| 5,713,669 | A | 2/1998 | Thomas et al. | |
| 5,798,169 | A * | 8/1998 | Smith | 428/212 |
| 5,902,045 | A * | 5/1999 | Resteghini | 383/31 |
| 5,956,815 | A | 9/1999 | O'Connor et al. | |
| 5,964,532 | A | 10/1999 | St. Phillips et al. | |
| 6,247,843 | B1 | 6/2001 | Buchman | |
| 6,264,366 | B1 | 7/2001 | Custer | |
| 6,354,738 | B1 | 3/2002 | Buckman et al. | |
| 6,386,760 | B1 | 5/2002 | Tomic | |
| 6,390,676 | B1 | 5/2002 | Colombo et al. | |
| 6,409,384 | B1 | 6/2002 | Provan et al. | |
| 6,439,770 | B2 | 8/2002 | Catchman | |

(Continued)

FOREIGN PATENT DOCUMENTS

| | | |
|---|---|---|
| EP | 0 450 741 | 10/1991 |

(Continued)

*Primary Examiner*—Hemant M Desai
(74) *Attorney, Agent, or Firm*—Frost Brown Todd LLC

(57) ABSTRACT

A bag is has an opening defined by a pair of walls and a pair of gussets. The walls are joined by the gussets. The bag has two slits. Each of the two slits is formed adjacent a wall and a gusset. Each of the two slits is adjacent the opening. A zipper comprises a pair of interlocking sections. The zipper is inserted through the slits. The interlocking sections are secured to at least a portion of each of the walls.

19 Claims, 8 Drawing Sheets

U.S. PATENT DOCUMENTS

| | | | | |
|---|---|---|---|---|
| 6,461,042 | B1 | 10/2002 | Tomic et al. | |
| 6,467,956 | B1 | 10/2002 | Tilman et al. | |
| 6,474,866 | B2 | 11/2002 | Buchman | |
| 6,481,891 | B2 | 11/2002 | Yeager | |
| 6,488,410 | B2 | 12/2002 | Schneider | |
| 6,517,242 | B1 | 2/2003 | Buchman | |
| 6,572,266 | B2 | 6/2003 | Buchman | |
| 6,595,690 | B2 | 7/2003 | Machacek | |
| 6,820,395 | B2 * | 11/2004 | Ausnit | 53/412 |
| 6,826,808 | B2 | 12/2004 | Kutschka | |
| 6,866,420 | B2 | 3/2005 | Buchman | |
| 6,874,935 | B2 * | 4/2005 | Edelman et al. | 383/5 |
| 6,908,422 | B2 * | 6/2005 | Ichikawa et al. | 493/186 |
| 6,918,234 | B2 * | 7/2005 | Thomas et al. | 53/450 |
| 6,993,886 | B2 * | 2/2006 | Johnson | 53/412 |
| 7,086,782 | B2 * | 8/2006 | Strand et al. | 383/61.2 |
| 7,254,873 | B2 * | 8/2007 | Stolmeier et al. | 24/400 |
| 7,322,920 | B2 * | 1/2008 | Johnson | 493/213 |
| 2003/0002753 | A1 | 1/2003 | Stolmeier et al. | |
| 2003/0072502 | A1 * | 4/2003 | Strand et al. | 383/5 |
| 2003/0072504 | A1 * | 4/2003 | Strand et al. | 383/5 |
| 2003/0103690 | A1 | 6/2003 | Schneider et al. | |
| 2003/0223652 | A1 | 12/2003 | Schneider | |
| 2004/0058039 | A1 | 3/2004 | Strand et al. | |
| 2004/0091648 | A1 | 5/2004 | Hartzell et al. | |
| 2006/0072859 | A1 | 4/2006 | Melchoir et al. | |

FOREIGN PATENT DOCUMENTS

| | | |
|---|---|---|
| EP | 1 132 311 | 9/2001 |
| WO | WO 01/53158 | 7/2001 |

* cited by examiner

METHOD FOR APPLYING A RECLOSABLE SEAL TO A CONTAINER

BACKGROUND

Reclosable seals are used in a variety of applications, one example being for sealing the opening of a bag. A variety of methods for applying reclosable seals to containers currently exist, but no one prior to the inventors has created or used the invention described in the appended claims.

BRIEF DESCRIPTION OF THE DRAWINGS

While the specification concludes with claims that particularly point out and distinctly claim the invention, it is believed the present invention will be better understood from the following description taken in conjunction with the accompanying drawings, in which like reference numerals identify the same elements. The drawings and detailed description which follow are intended to be merely illustrative and are not intended to limit the scope of the invention as set forth in the appended claims.

DETAILED DESCRIPTION

The following description should not be used to limit the scope of the present invention. Other examples, features, aspects, embodiments, and advantages of the invention will become apparent to those skilled in the art from the following description, which includes by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive. It should therefore be understood that the inventors contemplate a variety of embodiments that are not explicitly disclosed herein.

Figure 1:
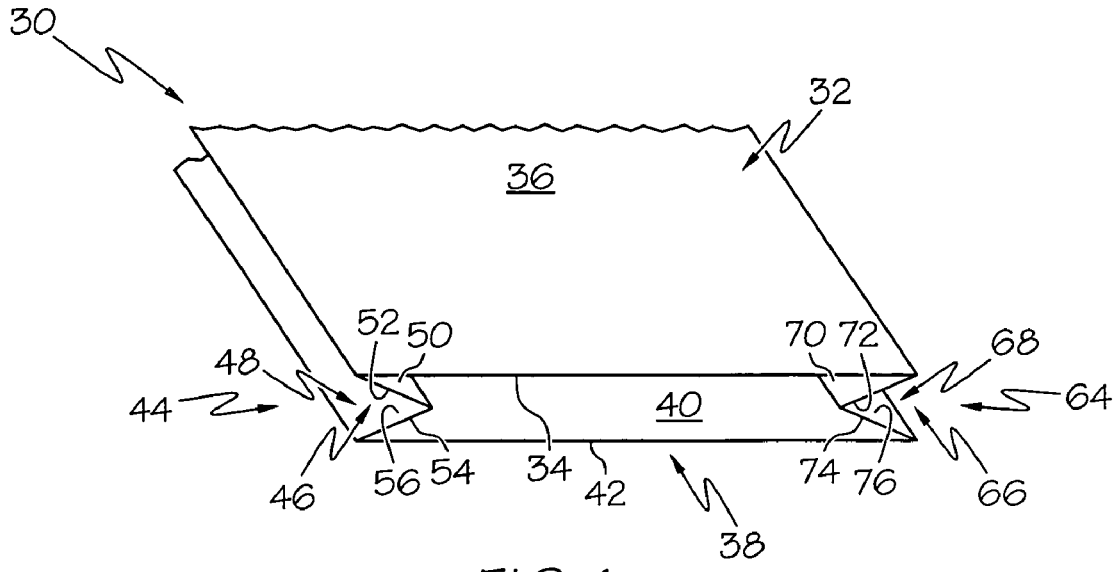
FIG. 1 depicts a perspective view of a bag.

FIG. 1 depicts a bag (30) having a top wall (32) and a bottom wall (38). Top wall (32) has an inner surface (34) and an outer surface (36). Similarly, bottom wall (38) has an inner surface (40) and an outer surface (42). In the present example, bag (30) is gusseted, such that bag (30) has a left gusset (44) and a right gusset (64). Left and right gussets (44, 64) are each adjacent top wall (32) and bottom wall (38), and are configured to fold or bend in an accordion-like fashion. Left gusset (44) comprises a top portion (46) and a bottom portion (48). Top portion (46) of left gusset (44) has an inner surface (50) and an outer surface (52). Bottom portion (48) of left gusset (44) also has an inner surface (54) and an outer surface (56). Similarly, right gusset (64) comprises a top portion (66) and a bottom portion (68), each having an inner surface (70 and 74, respectively) and an outer surface (72 and 76, respectively).

Figure 3:
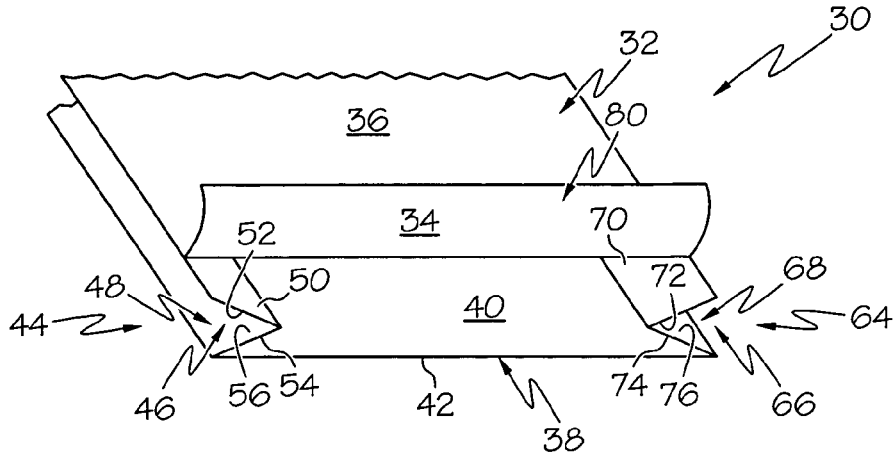
FIG. 3 depicts perspective view of the bag of FIG. 1 with a portion of a wall raised.
Figure 4:
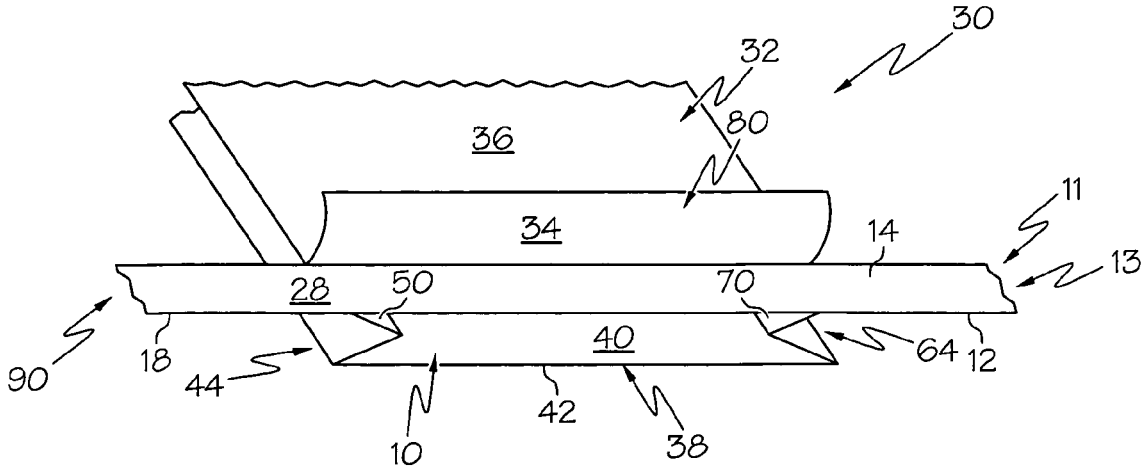
FIG. 4 depicts a perspective view of the bag of FIG. 3 with the reclosable seal of FIG. 2 inserted adjacent the raised portion of the bag wall.

In FIGS. 1, 3, and 4, the degree of spatial separation between top wall (32) and bottom wall (38) is emphasized for illustrative purposes only. It will be appreciated that, during performance of the methods disclosed herein, top wall (32) may be closer to bottom wall (38) (e.g., such that the overall thickness of bag (30) is reduced, such that less space is provided between walls (32, 38), etc.). In addition, while the present example includes a bag (30), it will be appreciated that a zipper (10) or any other reclosable seal may be used on any other type of container or receptacle, including but not limited to envelopes, pouches, sacks, and the like. As used herein, the terms "container" and "receptacle" and the like shall be read to include anything configured to hold and substantially contain an object or materials. To the extent that the container is a bag, it will be appreciated that any type of bag may be used, including but not limited to gusseted, non-gusseted, paper, plastic, multi-laminate, woven polypropylene bags, and the like. In one embodiment, the container comprises a bag (30) having a plurality of layers, with at least one of the layers being a paper material, and at least one other layer (e.g., the outer layer) being a heat-sealable material. Other suitable containers, materials, and configurations will be apparent to those of ordinary skill in the art. Similarly, other suitable reclosable seals will be apparent to those of ordinary skill in the art, including but not limited to other variations of zipper (10).

Figure 2:
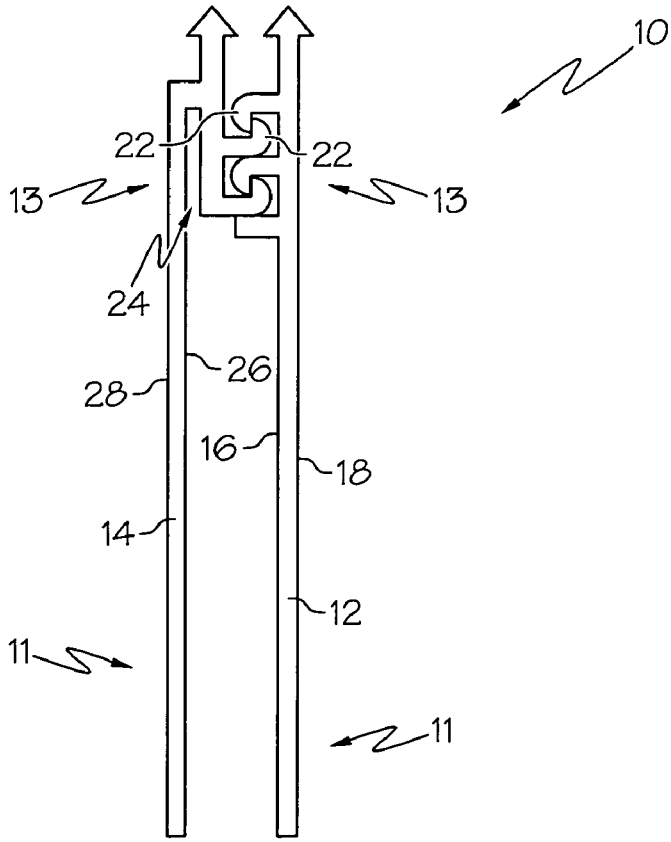
FIG. 2 depicts a transverse cross-sectional view of a reclosable seal.

FIG. 2 depicts a reclosable seal in the form of a zipper (10). Zipper (10) has a right interlocking section (12) and a left interlocking section (14). Right interlocking section (12) and left interlocking section (14) each have a pair of complimentary teeth (22) extending the length of the respective interlocking sections (12, 14). Of course, each interlocking section (12, 14) could have a single tooth (22), rather than a plurality of teeth (22), or any number of teeth (22). Right interlocking section (12) has an inner surface (16) and an outer surface (18). Similarly, left interlocking section (14) has an inner surface (26) and an outer surface (28). Each interlocking section (12, 14) of the present example further comprises a flange region (11), which is below a top portion (13) of each interlocking section (12, 14) and adjacent to teeth (22). In one embodiment, interlocking sections (12, 14) comprise a pair of profiles. Other suitable interlocking sections (12, 14) will be apparent to those of ordinary skill in the art, including but not limited to zippers with metal teeth.

In the present left interlocking section (14), a hinge (24) is located adjacent teeth (22). It will be appreciated that hinge (24) may prevent inadvertent disengagement of teeth (22), such as by outward separation of flanges (11). Of course, right interlocking section (12) may include a hinge (24) in addition to or as an alternative to left interlocking section (14) having hinge (24). Alternatively, any suitable alternative to hinge (24) may be used, including but not limited to no hinge (24) at all.

As used herein, terms such as "top," "bottom," "right," "left," "above," "below," and the like are used simply to refer to the relative positioning of elements in the drawings, and are not intended to be limiting in any way.

Zipper (10) of the present example is configured to be secured to bag (30). It will be appreciated that interlocking sections (12, 14) of zipper (10) may be secured to bag (30) in any suitable fashion. In one embodiment, interlocking sections (12, 14) are secured to bag (30) by a pre-applied, heat-activated adhesive. Such adhesive may be activated by hot air, by hot rolling, or by any other suitable method. In another embodiment, interlocking sections (12, 14) are secured to bag (30) by an epoxy bond. In this embodiment, a first compound is applied to each interlocking section (12, 14) and a second compound is applied to the portions of bag (30) that will ultimately come into contact with interlocking sections (12, 14). The first and second compounds are configured such that, when joined together, the compounds form a physical bond. Accordingly, a bond is formed when interlocking sections (12, 14) are placed in contact with the aforementioned portions of bag (30), thereby securing interlocking sections (12, 14) to bag (30). Alternatively, any other technique may be used to secure interlocking sections (12, 14) to bag (30), including but not limited to heat-sealing, stitching, adhesives, press-sealing, cold welding, pressure bonding, double-sided tape. Where interlocking sections (12, 14) are stitched to bag (30), it will be appreciated that such stitching may include, by way of example only, sewing or ultrasonic stitching. Still other suitable techniques for securing interlocking sections (12, 14) to bag (30) will be apparent to those of ordinary skill in the art. In addition, it will be appreciated that zipper (10) may be secured to any other container.

In the present example, closure of zipper (10) results from engagement of teeth (22) of right interlocking section (12) with teeth (22) of left interlocking section (14), thereby effecting a seal of bag (30). As used herein, the term "seal" and its variants shall be read to generally imply the prevention of at least a substantial portion material (e.g., solids, gases, and/or liquids) from escaping or entering the container. However, such a "seal" need not per se be perfectly "air tight" or "water tight" as those phrases are commonly used and understood.

Interlocking sections (12, 14) of the present example comprise an extruded plastic material. In some embodiments of the methods disclosed herein, interlocking sections (12, 14) are joined together to form zipper (10) before being secured to bag (30). In some embodiments, extruded interlocking sections (12, 14) joined to form a continuous zipper strip (90). As used herein, the term "zipper" shall be read to include a zipper having a length that corresponds with the length of a container opening. The term "zipper strip" shall be read to include a continuous strip of zippers. In other words, a "zipper" is sized to be secured to a single container, whereas a "zipper strip" is sized such that it may be used to provide a plurality of zippers for a plurality of containers. Of course, interlocking sections (12, 14) and zippers (10) may be formed of any other suitable material, and by any other suitable process. Additionally, interlocking sections (12, 14) may be manipulated in any suitable fashion before, during, and/or after being secured to bag (30) or any other container.

FIGS. 3-6 illustrate portions of an exemplary method by which zipper (10) may be secured to bag (30). In the present example, as shown in FIG. 3, a slit is made in a region of bag (30) adjacent top wall (32) and top portion (46) of left gusset (44). A corresponding slit has been made in a region of bag (30) adjacent top wall (32) and top portion (66) of right gusset (64). These slits create a flap portion (80) of top wall (32), which is shown as being peeled away from other portions of bag (30). Flap portion (80) is shown as being peeled away for illustrative purposes only. It will be appreciated that, during performance of methods disclosed herein, flap portion (80) may be lifted away only slightly, otherwise manipulated, or not manipulated at all.

As shown in FIG. 4, after flap portion (80) has been provided, zipper (10) is inserted adjacent flap portion (80), above top portions (46, 66) of gussets (44, 64). In the present example, zipper (10) is slid into position from right gusset (64) toward left gusset (44). Alternatively, zipper (10) may be slid into position from left gusset (44) toward right gusset (64). In yet another embodiment, zipper (10) is slid into position in a direction transverse the length of zipper (10). It will be appreciated that, where zipper (10) is provided in the form of a zipper strip (90), zippers (10) may be positioned in a plurality of bags (30) in a continuous fashion, such as in a mass-production or other context. Still other ways in which zipper (10) may be positioned in bag (30) will be apparent to those of ordinary skill in the art.

Figure 5:
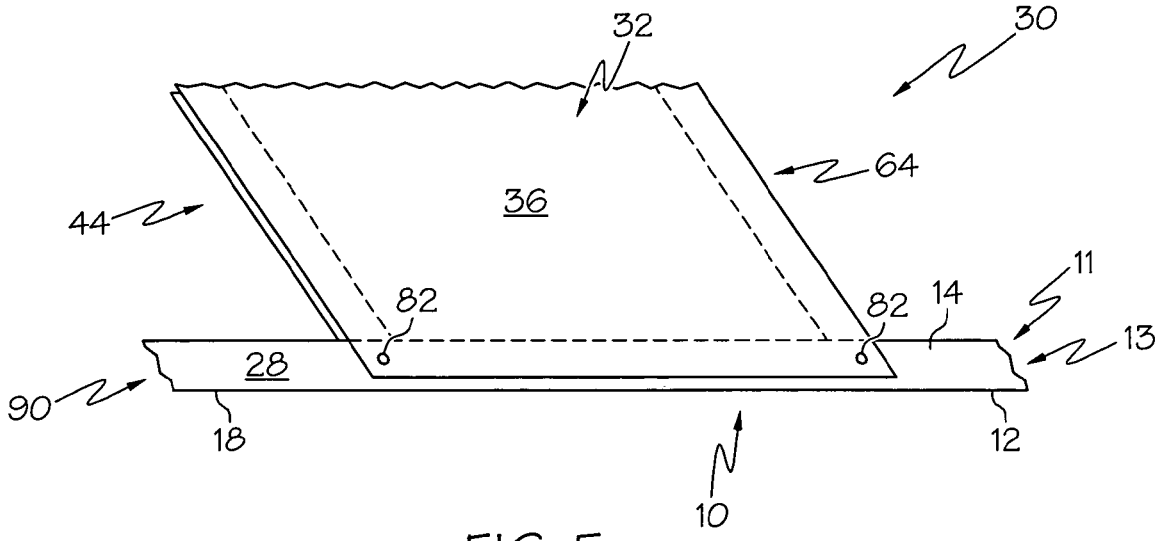
FIG. 5 depicts a perspective view of the bag of FIG. 4 with the reclosable seal secured to opposing bag walls.
Figure 6:
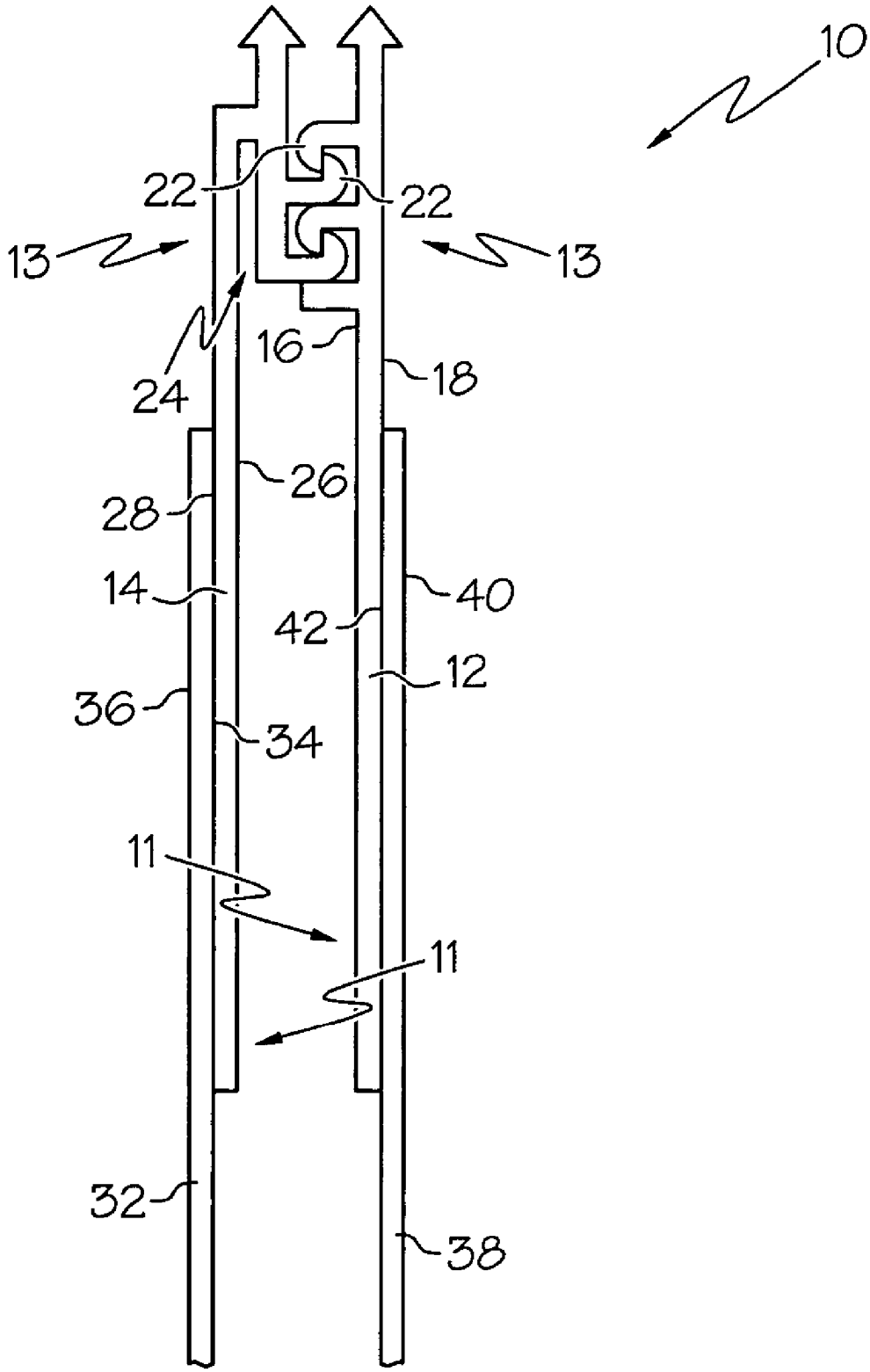
FIG. 6 depicts a transverse cross-sectional view of the bag and reclosable seal of FIG. 5.

In the present example, when zipper (10) is positioned in bag (30), flanges (11) are positioned between flap portion (80) and inner surface (40) of bottom wall (38). The sizing of the slits in bag (30) relative to the sizing of zipper (10) is such that top portion (13) of zipper (10) protrudes from the end of bag (30) when zipper (10) is positioned in bag (30). As shown in FIGS. 5 and 6, inner surface (34) of top bag wall (32) is secured to outer surface (28) of left flange (14), while outer surface (18) of right flange (12) is secured to inner surface (40) of bottom bag wall (38). In addition, the regions of right flange (12) that overlay gussets (44, 64) may be secured to inner surface (50, 70) of top portion (46, 66) of each gusset (44, 64). In the present example, rivets (82) are provided through each gusset (44, 64), passing through top and bottom bag walls (32, 38). It will be appreciated, however, that any suitable alternative or supplement to rivets (82) may be used, including but not limited to adhesives, stitching, clamps, clips, or any other means. Alternatively, rivets (82) may be eliminated.

In another embodiment, slits are made adjacent bottom bag wall (38) and bottom portion (48, 68) of each gusset (44, 64). In this embodiment, zipper (10) is inserted through the slits in a manner similar to that described above. In yet another embodiment, slits are made adjacent top portion (46, 66) of each gusset (44, 64) and bottom portion (48, 68) of each gusset (44, 64), and zipper (10) is inserted therethrough. Still other suitable locations for slits will be apparent to those of ordinary skill in the art.

In still another embodiment, only a single interlocking section (12 or 14) is inserted through the slits. In such an embodiment, the other interlocking section (14 or 12) may be positioned anywhere between bag walls (32, 38) or adjacent the outer surface (36, 42) of either bag wall (32, 38). Of course, any other relative configuration of zipper (10) and bag (30) may be used.

Figure 7:
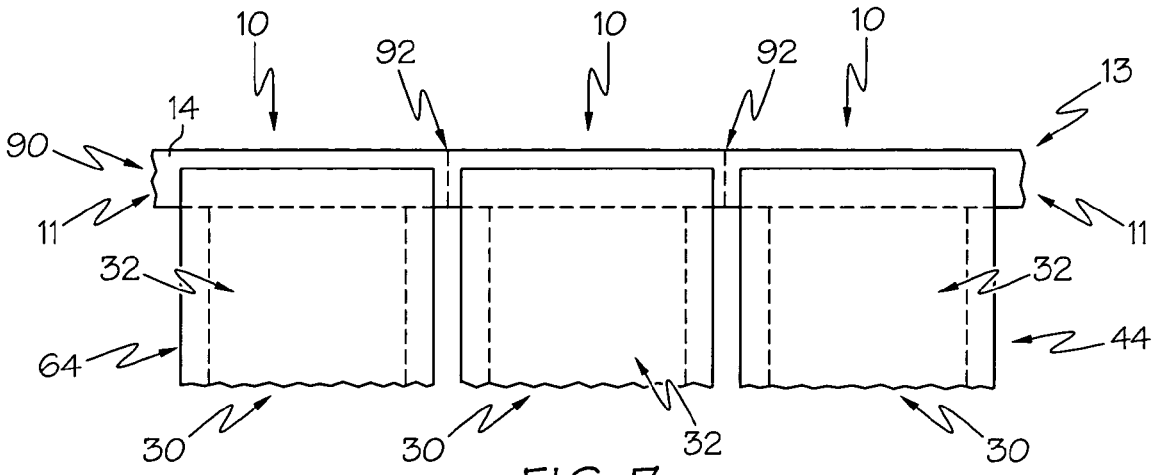
FIG. 7 depicts a series of bags secured to a reclosable seal strip.

In the present example, a zipper strip (90) is inserted in a plurality of bags (30) as shown in FIG. 7. Zippers (10) are secured to each bag (30). Zippers (10) are then separated from zipper strip (90) by a plurality of cuts (92), thereby forming a plurality of separate combinations of zippers (10) and bags (30). By way of example only, cuts (92) may be made with a hot knife, such that the portions of interlocking sections (12, 14) adjacent each cut (92) are sealed together substantially contemporaneously with the making of each cut (92). Of course, any other method for separating zippers (10) from sipper strip (90) may be used. In addition, cuts (92) may be made prior to zippers (10) being secured to bags (30).

Figure 8:
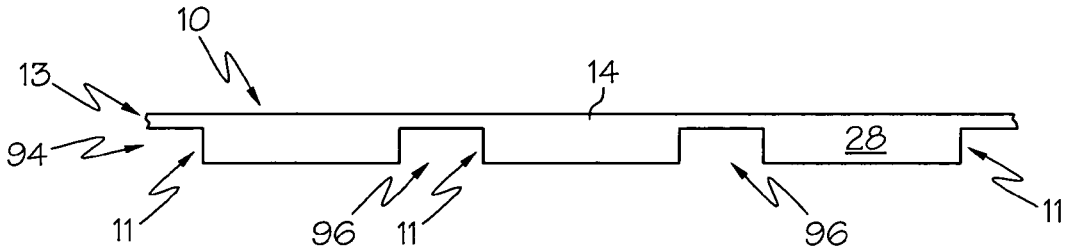
FIG. 8 depicts an alternative reclosable seal strip.
Figure 9:
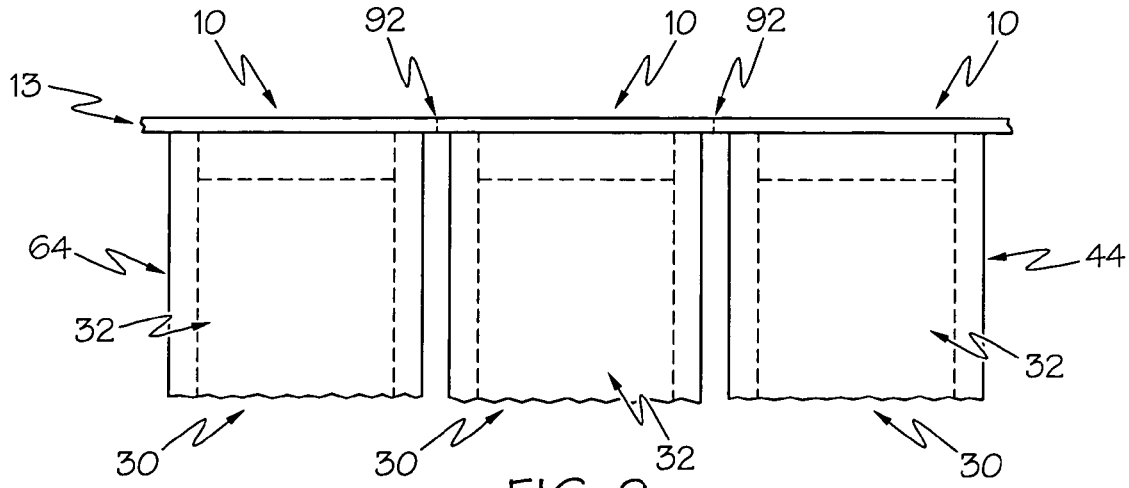
FIG. 9 depicts a series of bags secured to the reclosable seal strip of FIG. 8.

FIG. 8 shows an alternate zipper strip (94). In this embodiment, zipper strip (94) is essentially the same as zipper strip (90), except that a plurality of recesses (96) have been formed in flanges (11). Recesses (96) may be formed using any suitable technique, including but not limited to cutting, such as stamp-cutting. As shown in FIG. 9, recesses (96) are sized and spaced such that the remaining portions of flanges (11) have a length that approximately corresponds to the distance between gussets (44, 64) when bags (30) are substantially flat (e.g., when space between bag walls (32, 38) is minimized). With zippers (10) of zipper strip (94) positioned in bags (30), cuts (92) are made to separate zippers (10) from zipper strip (94). In this embodiment, no portion of zipper (10) is positioned between top bag wall (32) and gussets (44, 64). Still other variations of zipper strips (90, 94) will be apparent to those of ordinary skill in the art.

Those of ordinary skill in the art will further appreciate that it may be desirable to provide some kind of assurance or indication as to whether a zipper (10) and/or bag (30) has been previously opened. In other words, it may be desirable to provide a device that is configured to show whether a zipper (10) and/or bag (30) has been tampered with. As used herein, the term "tamper evidence device," including its variants, shall be read to include any feature, technique, and/or structure that is configured to provide evidence or indication that a bag (30) has been opened or otherwise tampered with. As used herein, the term "tamper" and its variants shall be read to include, but need not be limited to, an act of opening a bag (30) substantially or completely and/or gaining substantial or full access to its contents. An exemplary device for providing tamper evidence are shown in FIGS. 10-13. In this example, the tamper evidence device includes a type of seal that must be breached when the bag (30) is first opened completely (e.g., the first time complete access to the contents of bag (30) is gained). It will be appreciated, however, that the device described hereafter is merely exemplary, and that tamper evidence may be provided by a variety of alternative devices. It will also be appreciated that the following example and/or alternatives thereof may be used in isolation or in combination with one another. In addition, while the features of the following embodiment may provide tamper evidence, such features may also provide other functionality and benefits not explicitly discussed herein.

Figure 10:
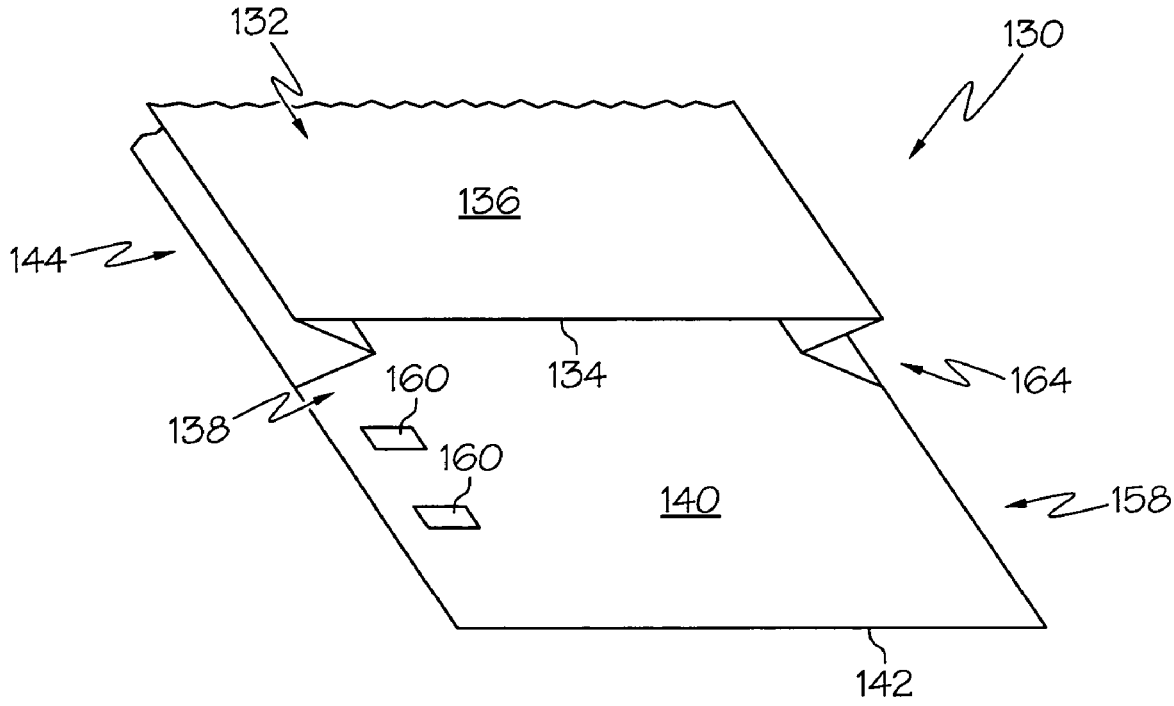
FIG. 10 depicts a perspective view of an alternative bag.

FIG. 10 shows an alternate bag (130) having features that may provide tamper evidence. Bag (130) has a top wall (132), a bottom wall (138), a left gusset (144), and a right gusset (164). Top wall (132) has an inner surface (134) and an outer surface (136). Similarly, bottom wall (138) has an inner surface (140) and an outer surface (142). Bottom wall (138) extends beyond other portions of bag (30) to form a hood (158). A pair of windows (160) are formed in hood. It will be appreciated that any of the heretofore described methods may be performed with bag (130).

Figure 11:
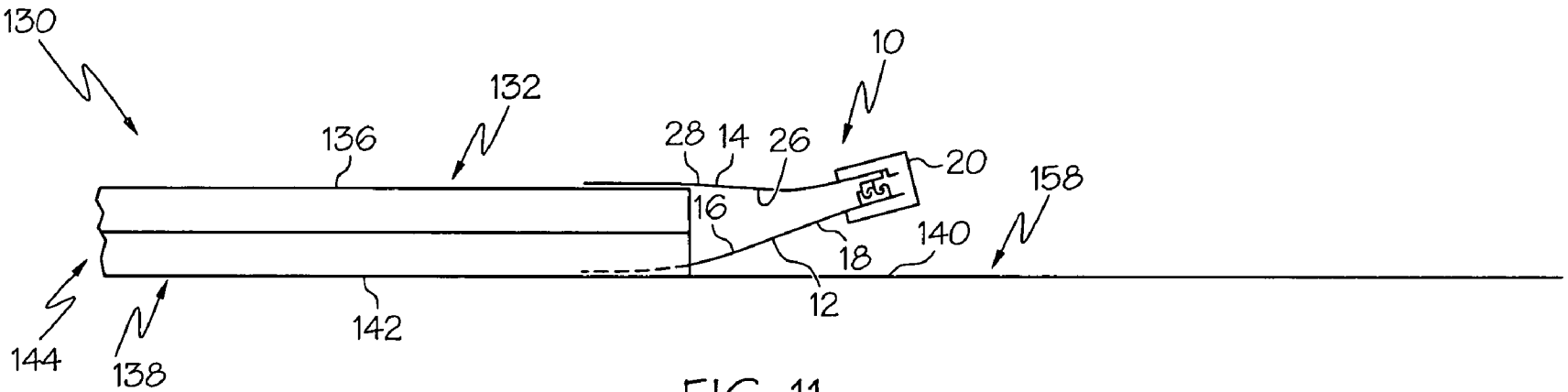
FIG. 11 depicts a transverse cross-sectional view of a reclosable seal secured to the bag of FIG. 10.

Engagement or disengagement of interlocking sections (12, 14) at teeth (22) may be effected or otherwise facilitated by a slider (20), which is shown in FIG. 11. Slider (20) is configured to slide longitudinally along zipper (10) to bring interlocking sections (12, 14) together into engagement or force interlocking sections (12, 14) apart for disengagement, depending upon which direction slider (20) is slid. Sliders (20) are well known in the art, and any type of slider (20) may be used. In one embodiment, slider (20) comprises a glider. Of course, slider (20) is optional, and any suitable alternative to or form of slider (20) may be used, including but not limited to no slider (20) at all.

In FIG. 11, zipper (10) is partially inserted in bag (130). Left interlocking section (14) is positioned outside of bag (130), while right interlocking section (12) is positioned inside of bag (130). Inner surface (26) of left interlocking section (14) is secured to outer surface (136) of top wall (132); while outer surface (18) of right interlocking section (12) is secured to inner surface (140) of bottom wall (138). Of course, any other relative positioning of zipper (10) and bag (130) may be used. For instance, outer surface (28) of left interlocking section (14) may be secured to inner surface (134) of top wall (132). Other suitable configurations will be apparent to those of ordinary skill in the art.

Figure 12:
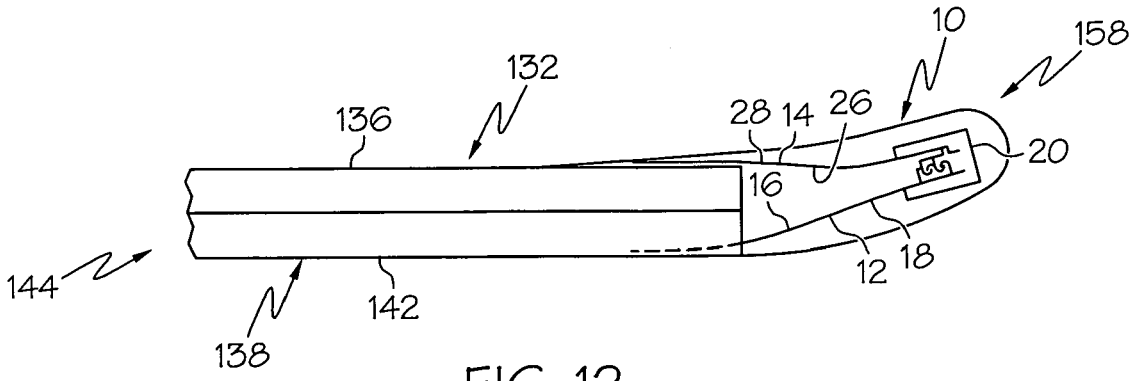
FIG. 12 depicts a transverse cross-sectional view of the bag and reclosable seal of FIG. 11 with a folded bag hood.
Figure 13:
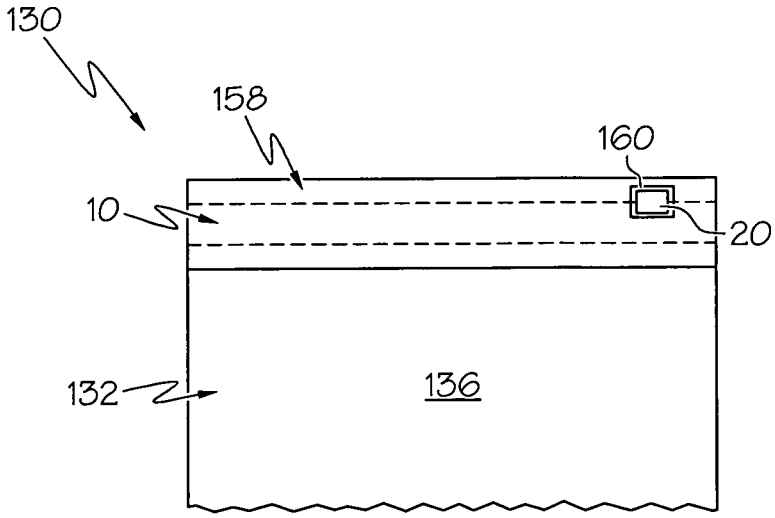
FIG. 13 depicts a front elevational view of the bag and reclosable seal of FIG. 12.

With zipper (10) secured to bag (130), hood (158) is folded over zipper (10) and secured to outer surface (136) of top wall (132), as shown in FIGS. 12 and 13. Alternatively, or additionally, hood (158) may be secured to left interlocking section (14). In either case, windows (160) are configured such that, with hood (158) folded over, slider (20) may be seen through windows (160). In other words, the dimensions of windows (160) correspond to the dimensions of slider (20). Of course, windows (160) may be eliminated.

In the above-described embodiment having a folded-over hood (158), hood (158) may need to be breached, torn, peeled away, or otherwise manipulated in order to gain initial access to the contents of bag (130). Accordingly, hood (158) may provide tamper evidence. For instance, a torn hood (158) or a hood that has been peeled away from top wall (132) may provide an indication that bag (130) has been opened; while an intact hood (158) may provide an indication that bag (130) has not been opened.

Various features may be provided to facilitate initial access to contents of bag (130). For instance, a tab or pull string may be provided to create a tear through the folded-over hood (158). Alternatively, or in addition, a perforation or similar weakening feature may be provided in hood (158). Of course, any other feature for facilitating initial access to contents of bag (130) may be used. It will also be appreciated that hood (158) may be comprise one or more features to facilitate partial removal of hood (158) from bag (130) (e.g., by tearing one side of hood) or complete removal of hood (158) from bag (130). In addition, it will be appreciated that removal of hood (158) may result in partial or full exposure of slider (20) and zipper (10). Still other variations of hood (158) and hood (158) manipulation will be apparent to those of ordinary skill in the art.

While the foregoing tamper evidence device has been described as providing a way in which tampering may be detected, it will be appreciated that such device may provide other uses as well. By way of example only, it will be appreciated that during the normal course of handling of a given container, for instance from the time it is filled to the time it reaches a shelf in a retail setting, the handling may urge slider (20) to move, interlocking sections (12, 14) to separate, or lead to other potentially undesirable results. The foregoing tamper evidence device may provide resistance to those and other results. For instance, and without limitation, engagement between slider (20) and windows (160) may prevent undesired movement of slider (20) along zipper (10). In other words, windows (160) may substantially hold slider (20) in place. By permitting viewing of slider (160) through hood (158), windows (160) may also provide a visual indication that slider (20) remains in an initial position. Other results that may be provided by windows (160) and hood (158), as well as alternative features for providing similar results, will be apparent to those of ordinary skill in the art.

Of course, the foregoing examples are merely illustrative, and are not intended to be limiting in any way.

Having shown and described various embodiments and concepts of the invention, further adaptations of the methods and systems described herein can be accomplished by appropriate modifications by one of ordinary skill in the art without departing from the scope of the invention. Several of such potential alternatives, modifications, and variations have been mentioned, and others will be apparent to those skilled in the art in light of the foregoing teachings. Accordingly, the invention is intended to embrace all such alternatives, modifications and variations as may fall within the spirit and scope of the appended claims and is understood not to be limited to the details of structure and operation shown and described in the specification and drawings.

The invention claimed is:

1. A method for applying a reclosable seal to a container, the method comprising:

(a) providing a container, wherein the container has an opening;

(b) forming one or more slits in the container, wherein each of the one or more slits is proximate to the opening, wherein the slits define a flap portion;

(c) providing a reclosable seal, wherein the reclosable seal comprises a pair of interlocking sections;

(d) inserting the reclosable seal in the one or more slits; and (e) securing each interlocking section of the reclosable seal to the container.

2. The method of claim 1, wherein the container is a bag.

3. The method of claim 2, wherein the bag is gusseted.

4. The method of claim 2, wherein the bag comprises a paper material.

5. The method of claim 1, wherein the container comprises two walls and two gussets, wherein the two gussets join the two walls.

6. The method of claim 5, wherein each of the at least one slits is formed adjacent to a wall and a gusset.

7. The method of claim 1, wherein the reclosable seal comprises a strip, wherein the strip is dimensioned such that the strip may be applied to a plurality of containers.

8. The method of claim 7, wherein each interlocking section has a flange portion, wherein each flange portion comprises a plurality of recesses.

9. The method of claim 1, wherein the each interlocking section of the reclosable seal is secured to the container with an adhesive.

10. The method of claim 1, wherein the container has a hood, wherein the method further comprises folding the hold over the reclosable seal.

11. The method of claim 1, further comprising raising at least a portion of the flap portion away from the opening prior to the act of inserting the reclosable seal.

12. A method for applying a zipper to a bag, the method comprising:

(a) providing a bag, wherein the bag has an opening defined by a pair of walls and a pair of gussets, wherein the walls are joined by the gussets, wherein the bag has two slits, wherein each of the two slits is formed adjacent a wall and a gusset, wherein each of the two slits is adjacent the opening;

(b) providing a zipper, wherein the zipper comprises a pair of interlocking sections;

(c) inserting the zipper through the slits;

(d) securing the interlocking sections to at least a portion of each of the walls.

13. The method of claim 12, wherein the slits define a flap portion in one of the walls, wherein the zipper is inserted between the flap portion and the gussets.

14. The method of claim 12, further comprising providing a rivet through each gusset.

15. The method of claim 12, wherein one of the walls comprises a hood portion, wherein the method further comprises folding the hood portion over the zipper and securing the hood portion to the other of the walls.

16. A method for preparing a container with a reclosable seal, the method comprising:

(a) providing a container, wherein the container has an opening, and wherein the container has a hood adjacent the opening;

(b) providing a zipper, wherein the zipper has a pair of flanges;

(c) applying the zipper to the container adjacent the opening;

(d) securing the flanges of the zipper to the container;

(e) folding the hood over at least a portion of the zipper; and (f) securing a portion of the hood to a portion of the container;

wherein one of the flanges of the zipper is positioned in the opening of the container, wherein another of the flanges of the zipper is positioned outside the opening of the container.

17. The method of claim 16, wherein the container comprises a gusseted paper bag.

18. The method of claim 17, wherein the zipper further comprises a slider.

19. The method of claim 18, wherein the hood comprises one or more windows, wherein each of the one or more windows is sized to provide a view of the slider through the hood after the act of folding the hood has been performed.

* * * * *